US006508095B1

(12) United States Patent
Brinkman et al.

(10) Patent No.: US 6,508,095 B1
(45) Date of Patent: Jan. 21, 2003

(54) THREAD-ROLLING END-WORKING ATTACHMENT

(75) Inventors: Robert J. Brinkman, Rochester, NY (US); Paul P. Francia, Rochester, NY (US); Sandro G. Belpanno, Rochester, NY (US)

(73) Assignee: C. J. Winter Machines Technologies, Inc., Rochester, NY (US)

( * ) Notice: Subject to any disclaimer, the term of this patent is extended or adjusted under 35 U.S.C. 154(b) by 0 days.

(21) Appl. No.: 09/857,593

(22) PCT Filed: Mar. 10, 2000

(86) PCT No.: PCT/US00/06454

§ 371 (c)(1),
(2), (4) Date: Jun. 7, 2001

(87) PCT Pub. No.: WO01/68288

PCT Pub. Date: Sep. 20, 2001

(51) Int. Cl.[7] ..... B21H 3/04
(52) U.S. Cl. ..... 72/104; 72/108
(58) Field of Search ..... 72/80, 104, 107, 72/108, 110, 112, 121, 124, 126

(56) References Cited

U.S. PATENT DOCUMENTS 2,384,457 A * 9/1945 Dewey ..... 72/100
2,422,849 A * 6/1947 Plagemann ..... 72/100
2,475,084 A * 7/1949 Drissner et al. ..... 72/104
2,771,799 A * 11/1956 Batchelder ..... 72/104
3,793,866 A * 2/1974 Anderson et al. ..... 72/88
3,913,365 A * 10/1975 Kruse ..... 72/104
4,336,703 A * 6/1982 Thomas ..... 72/102
5,467,627 A * 11/1995 Smith et al. ..... 72/121
6,135,903 A * 10/2000 Savard ..... 474/80

* cited by examiner

*Primary Examiner*—Allen Ostrager
*Assistant Examiner*—John S Goetz
(74) *Attorney, Agent, or Firm*—Phillips, Lytle, Hitchcock, Blaine & Huber LLP

(57) ABSTRACT

An improved end-working attachment (30) for a screw machine or a rotary transfer machine is particularly suited for use in rolling threads on a workpiece. The attachment broadly comprises: a slide base (31) having an axis (y-y); at least two members (32, 32) mounted on the slide base for sliding movement in a radial direction toward and away from the slide base axis; a tool, such as a thread die (33), on each member; an infeed mechanism (34) for selectively causing the slide members to move toward the slide base axis such that said tools will engage said workpiece; and a return mechanism (35) for urging the members to move away from the slide base axis.

9 Claims, 6 Drawing Sheets

THREAD-ROLLING END-WORKING ATTACHMENT

TECHNICAL FIELD

The present invention relates generally to the cold-working of workpieces, and, more particularly, to an improved end-working attachment or device for use in a screw machine or a rotary transfer machine, and which is particularly suited for use in rolling threads on a workpiece.

BACKGROUND ART

It is known to roll threads on a workpiece. For example, U.S. Pat. No. 3,913,365 discloses a method and machine for rolling threads. Basically, this patent teaches that a plurality (i.e., two or more) of thread-rolling dies may be initially positioned adjacent a workpiece. In the embodiment shown in FIG. 1 of this patent, two dies are provided. However, the embodiment shown in FIG. 10 has three dies. In either event, each die has a cam surface that includes a flattened portion, a first section of gradually-increasing radius, a second section of constant radius, and a third section of gradually-decreasing radius. The dies are interconnected via a gear train. The dies are initially arranged such that the flats thereon are arranged in closely-spaced facing relation to the portion of the workpiece on which the thread is to be rolled. Thereafter, the dies are synchronously rotated through one complete revolution to roll a thread on the workpiece.

This arrangement suffers certain drawbacks. First, the mechanism that displaces the dies is generally of limited stroke, and is not readily adaptable for use with a wide range of differently-sized workpieces. Second, because the dies are connected through a gear train and are not able to adjust with respect to their specific points of engagement with the workpiece, the thread dies can often bind and produce undesirable deformities in the thread form being rolled on the workpiece. Third, the rate at which the threads are formed, or the material displacement rate, is fixed by the roll geometry. Since it is not adjustable by the machine operator, this can lead to poor thread quality. Fourth, the die geometry often required specialized manufacturing techniques, and can be cost-prohibitive.

It is also known to provide other types of thread-rolling heads and attachments as well. These are representatively shown and described in U.S. Pat. Nos. 5,784,912, 4,336,703, 5,379,623, 5,568,743 and 5,924,317. The aggregate disclosures of these prior art references are hereby incorporated by reference insofar as the structure and operation of prior art thread-rolling machines and mechanisms are concerned.

Accordingly, it would be generally desirable to provide an improved thread-rolling attachment that is relatively compact, and that affords the capability of a greater range of die travel in a radial direction than available heretofore. This greater range might allow the dies to be moved sufficiently apart to offer the capability of over-the-shoulder thread-rolling. Such a shoulder is typically formed by an annular vertical surface surrounding a relatively narrow cylindrical portion of a rod-like member. For example, a valve spool might have a relatively-narrow shaft, and a radially-enlarged lobe thereon. The lobe would have annular vertical surfaces on either side of the lobe. An over-the-shoulder thread-rolling operation would entail moving the dies far apart, axially moving the dies past the lobe, and thereafter moving the dies radially inwardly to roll a thread on the workpiece on the far side of the lobe. Of course, this particular illustration is only one example of such over-the-shoulder operation.

It would also be desirable to provide an improved thread-rolling attachment that could be used on either a screw machine or on a rotary transfer machine.

DISCLOSURE OF THE INVENTION

With parenthetical reference to the corresponding parts, portions or surfaces of the disclosed embodiment, merely for purposes of illustration and not by way of limitation, the present invention broadly provides an improved device (30) for imparting an action to a workpiece (W). The improved device broadly includes: a slide base (31) having an axis (y-y), at least two members (32, 32) mounted on the slide base for sliding movement in a radial direction toward and away from the slide base axis; a tool, such as a thread die (33, 33), on each member; and infeed mechanism (34) for selectively causing the members to move toward the slide base axis such that the tools will engage the workpiece; and a return mechanism (35) for biasing or causing the slide members to move away from the slide base axis.

The improved device may be mounted on a screw machine in which the workpiece is rotated relative to the stationary device, or a rotary transfer machine in which the device is rotated relative to the stationary workpiece. Conceivably, the workpiece and the device might be simultaneously rotated to produce differential relative movement therebetween, and the device might possibly be used on some other type of machine as well.

In the preferred embodiment, the tools are thread-forming dies. However, other types of tools (e.g., tools for knurling, burnishing, or performing other types of forming or cutting operations, etc.) could readily be substituted therefor.

The infeed mechanism (34) includes a shell (80) movable axially relative to the slide base, and wedges (90, 90) fixed on the shell and operatively arranged to cause radial sliding movement of the members in a direction toward the slide base axis as a function of axial movement of the shell relative to the slide base. The return mechanism may simply include a return spring acting between the two members and urging them apart.

In the preferred embodiment, a timing mechanism (93) is operatively arranged to synchronize the relative rotation of the dies, notwithstanding a large degree of relative radial movement therebetween. This timing mechanism allows one die to rotate with respect to the workpiece so as to self-adjust and closely follow the track of the other die. The timing mechanism may include a sprocket (94) mounted fast to each die, and an endless chain (95) engaging the die sprockets. This timing mechanism may further include two tensioning arms (96, 96). Each arm (96) has one end (98) pivotally mounted on the slide base, and has another end (99) biased to move toward the chain, with a freely-rotatable idler sprocket (100) mounted on the arm other end and engaging the chain.

Accordingly, the general object of the invention is to provide an improved device for imparting an action (e.g., threading, knurling, burnishing, some other forming or cutting operation, etc.) to a workpiece.

Another object is to provide an improved thread-rolling end-working attachment.

Still another object is to provide an improved thread-rolling end-working attachment, which may be used on a screw machine or on a rotary transfer machine, and which affords the capability of a high degree of die travel in a radial direction within the fixed confines of an outer envelope to accommodate a wide range of differently-sized workpieces, and to afford the capability of an over-the-shoulder thread-rolling operation.

These and other objects and advantages will become apparent from the foregoing and ongoing written specification, the drawings, and the appended claims.

DESCRIPTION OF THE PREFERRED EMBODIMENTS

Figure 1:
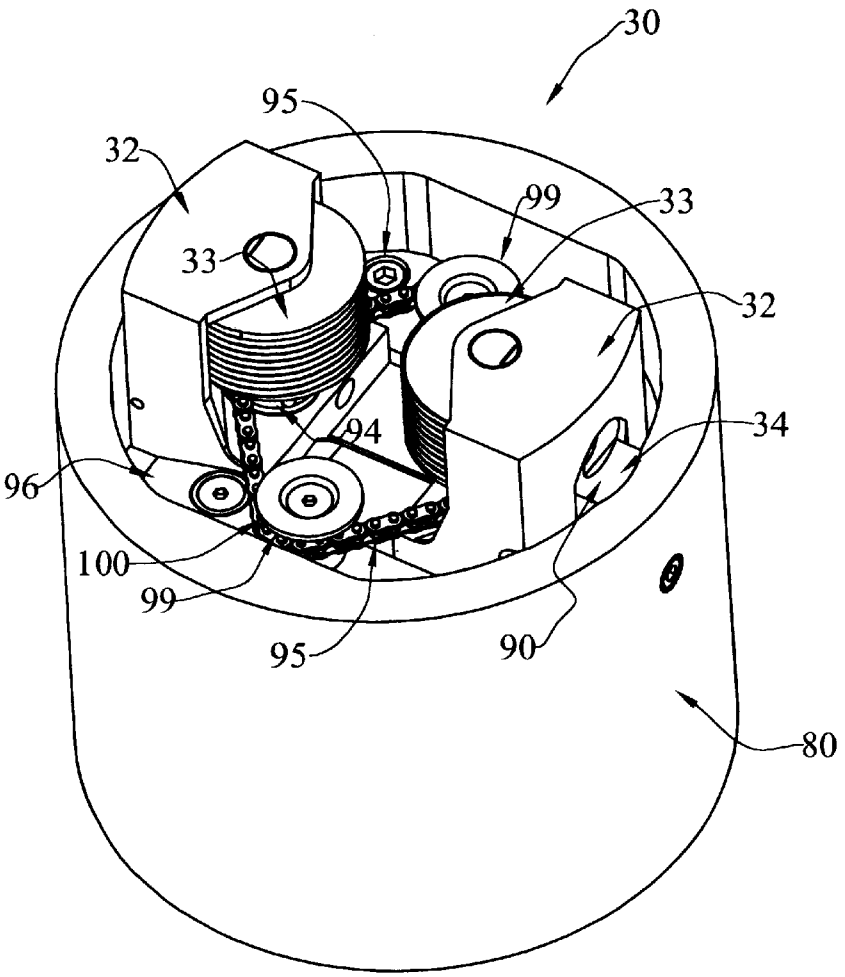
FIG. 1 is an isometric view of a presently-preferred form of an improved thread-rolling end-working attachment.
Figure 2:
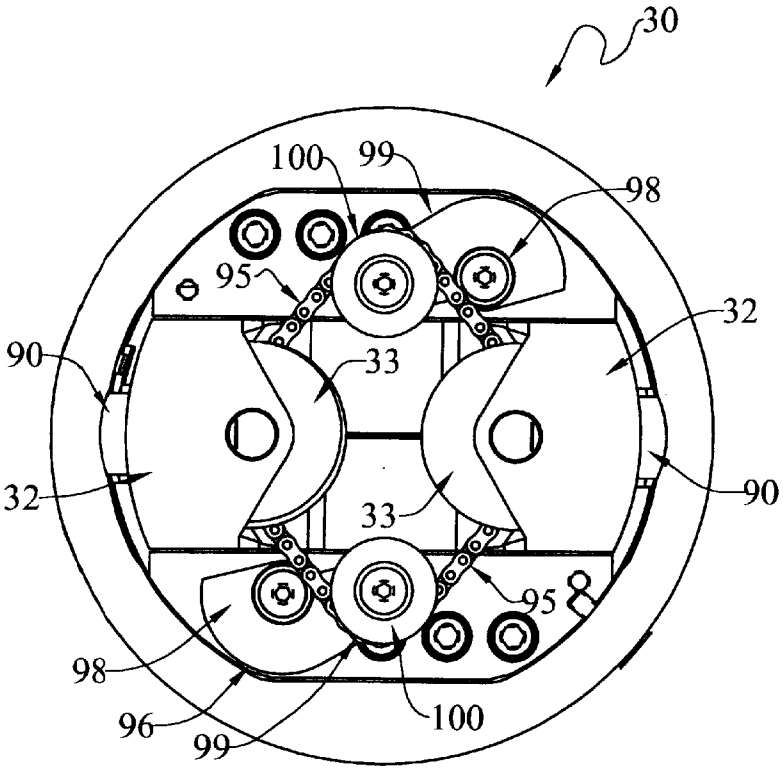
FIG. 2 is an end elevation of the attachment shown in FIG. 1.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Figure 4:
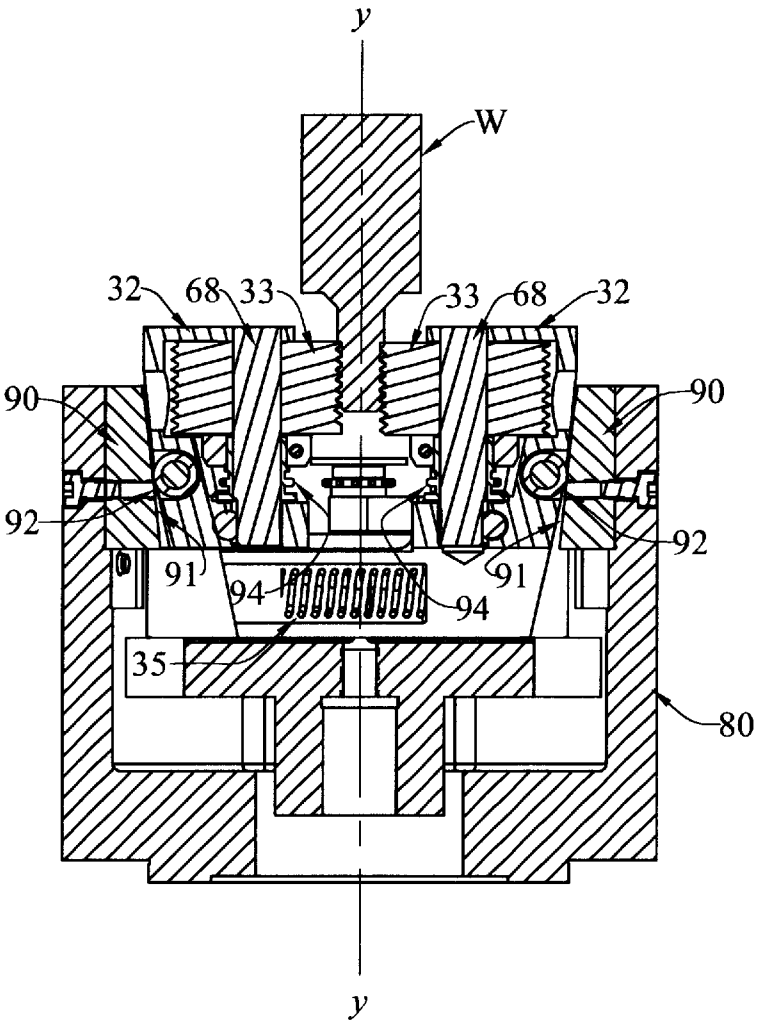
FIG. 4 is a view similar to FIG. 3, but showing the dies as having been displaced away from the attachment axis, and as engaging a portion of a workpiece.

Referring now to the drawings, and, more particularly, to FIGS. 1–4 thereof, the present invention provides a device, generally indicated at 30, for imparting an action to a workpiece, indicated at W in FIG. 4. The improved device is indicated as having a vertical axis y-y. The device broadly includes a slide base 31; at least two members, severally indicated at 32, mounted on the slide base for sliding movement in a radial direction toward and away from axis y-y; a tool 33, such as a thread die, mounted on each member; an infeed mechanism, generally indicated at 34, for selectively causing the members to move toward axis y-y such that the tools will engage the workpiece; and a return mechanism, generally indicated at 35, for biasing or urging the slide members to move away from the axis.

Figure 5:
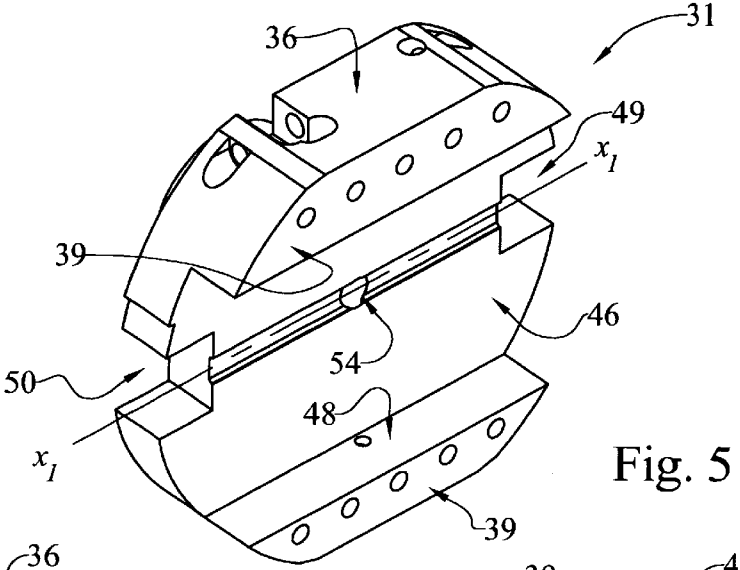
FIG. 5 is an isometric view of the slide base, with the slide members and shell removed.
Figure 6:
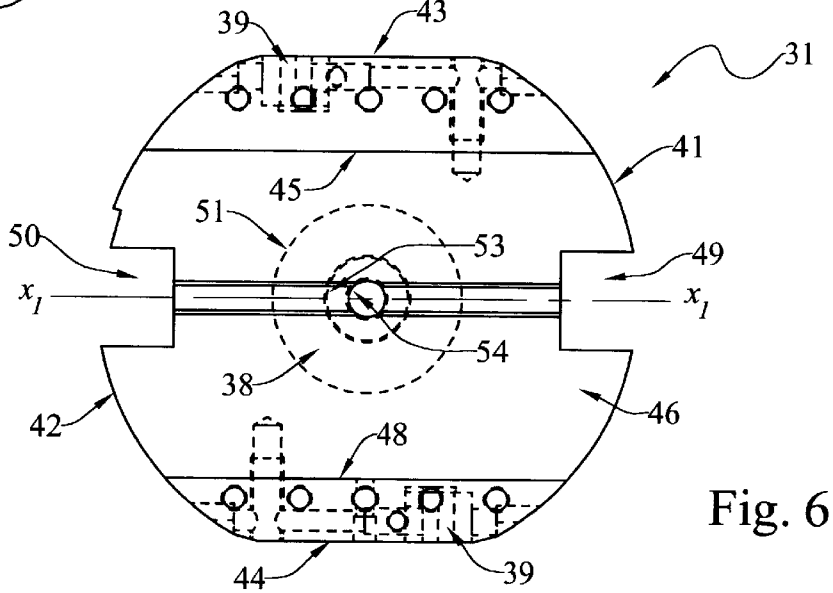
FIG. 6 is a side elevation of the slide base shown in FIG. 5.
Figure 7:
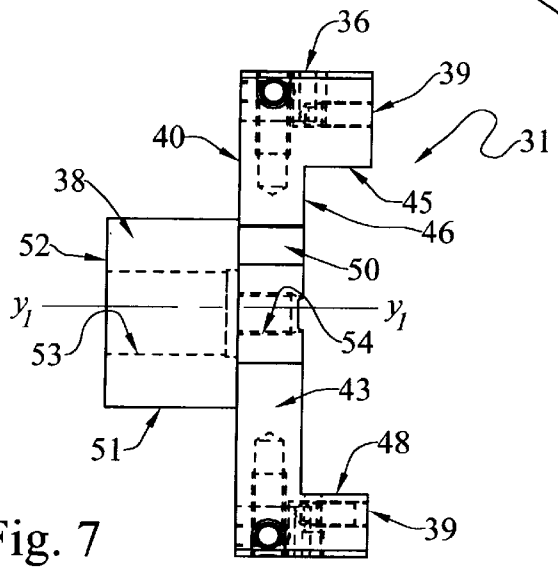
FIG. 7 is a left end elevation of the slide base shown in FIG. 6.
Figure 8:
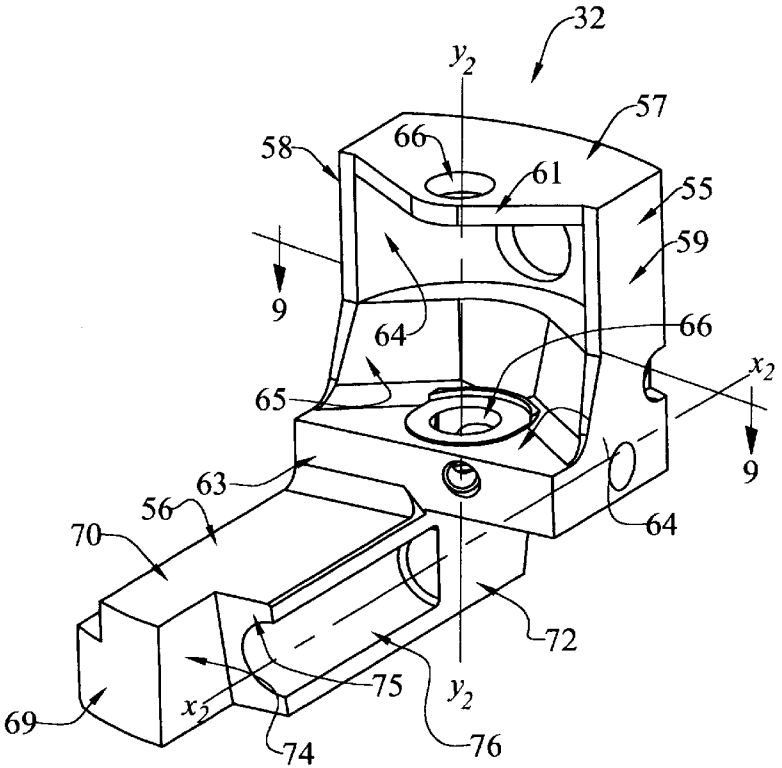
FIG. 8 is a left front isometric view of one of the slide members upon which a thread die is mounted.

Slide Base 31 (FIGS. 5–7)

As best shown in FIGS. 5–7, slide base 31 is a specially-configured member having a forward portion 36 and a rear portion 38. The forward portion appears to present a generally oval-shaped outline when viewed in elevation (FIG. 6), and is elongated along horizontal axis $x_1$-$x_1$. More particularly, the forward portion has a forwardly-facing planar vertical surface 39, and a rearwardly-facing planar vertical surface 40 from rear portion 38 extends. The forward portion is bounded by an oval-shaped periphery Which includes an arcuate right end surface 41, an arcuate left end surface 42, an upper horizontal surface 43, and a lower horizontal surface 44. Surfaces 41, 42 43, 44 extend between front and rear surfaces 39, 40, respectively. A slot-like recess, elongated along axis $x_1$-$x_1$, extends rearwardly into the slide base from front face 39, and communicates arcuate end surfaces 41, 42. More particularly, this recess is shown as being bounded by a downwardly-facing horizontal planar surface 45, a forwardly-facing planar vertical surface 46, and an upwardly-facing planar horizontal surface 48. A pair of rectangular notches 49, 50 extend longitudinally into the slide base from its arcuate end surfaces 41, 42, respectively. These notches also communicate slide base front and rear surfaces 40, 46.

As best shown in FIG. 7, the slide base rear portion 38 is in the form of a collar having a horizontal cylindrical outer surface 51, and a leftwardly-facing annular vertical end face 52. The slide base has a stepped through-hole along axis $y_1$-$y_1$, which hole is bounded by a relatively large diameter hole 53 extending rightwardly and axially into the collar from its left end face, a leftwardly-facing annular vertical shoulder surface (not numbered), and a smaller diameter tapped hole 54 continuing rightwardly through the slide base forward portion and opening onto slide base surface 46. The slide base is shown as having a plurality of holes (not numbered) to facilitate attachment to other structure.

When the device is assembled, slide base axis $y_1$-$y_1$, is coincident with device axis y-y.

Slide Member 32 (FIGS. 8–12)

Figure 9:
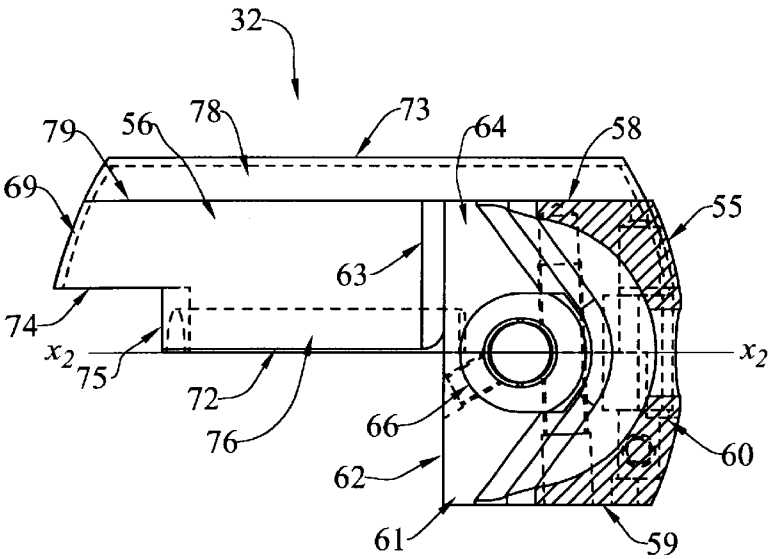
FIG. 9 is a fragmentary horizontal sectional view thereof, taken generally on line 9—9 of FIG. 8.

As noted above, two slide members, severally indicated at 32, are mounted on the slide base. These two members are structurally identical, and are operatively mounted on the slide base (see FIG. 3) in a reversed manner (i.e., rotated 180° from the other looking from the top, as seen in FIG. 9), to slide relative to one another. Since these slide members are the same, only one will be explicitly described.

Slide member 32 is shown as being a specially-configured machined member having an upper portion 55 and a lower portion 56. The upper portion is elongated along vertical axis $y_2$-$y_2$, and the lower portion is elongated along horizontal axis $x_2$-$x_2$.

The upper portion 55 is adapted to embrace a thread-rolling die 33, or some other cutting, turning or finishing tool (not shown). Upper portion 55 has an upper planar horizontal surface 57; planar left and right vertical side surfaces 58, 59, respectively; a rear cylindrically-segmented vertical surface 60; and a forwardly-facing surface that includes a narrow inverted U-shaped jamb-like strip 61 about the top and sides of a concave recess extending rearwardly into the upper portion, and a lower surface bounded by surfaces 62, 63, defining an upwardly-facing shelf surface, 64. Upper and lower concave recesses 64, 65 extend rearwardly into the upper portion from its forwardly-facing surfaces 61, 62, 63. The upper part has two aligned vertical holes, severally indicated at 66, to receive the opposite marginal end portions of a pin 68 (FIGS. 3–4) on which die 33 is rotatably mounted. When the attachment is assembled, the axes of holes 66, 66 on each slide member is arranged on an imaginary radial line with respect to device axis y-y.

As previously noted, the slide base lower part 56 is elongated along horizontal axis $x_2$-$x_2$. The lower part is shown as being a machined member having a forward cylindrically-segmented surface 69, an upwardly-facing horizontal planar surface 70, a downwardly-facing horizontal planar surface 71, a rightwardly-facing planar vertical surface 72 extending between the right margins of surfaces 70, 71, and a leftwardly-facing planar vertical surface 73 extending upwardly from the left margin of surface 71.

A corner notch joins surfaces 69, 72. More particularly, this notch is bounded by a rightwardly-facing planar vertical surface 74 extending rearwardly from the right margin of surface 69, and a forwardly-facing planar vertical surface 75 extending rightwardly from the rear margin of surface 74 and joining the forward margin of right side surface 72.

Figure 3:
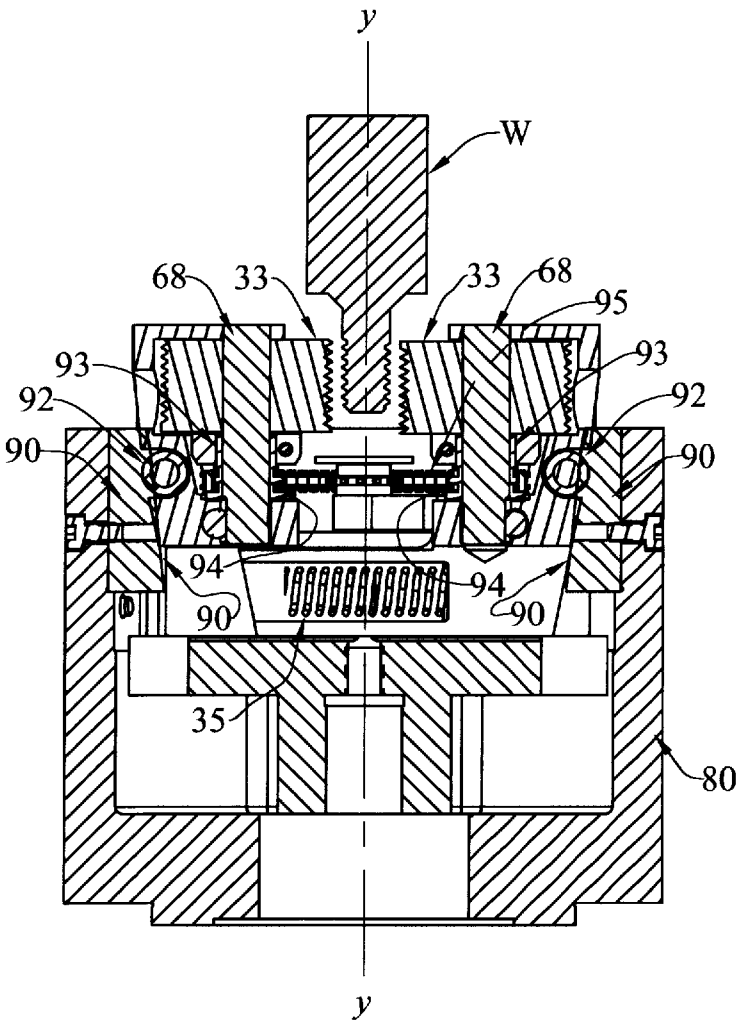
FIG. 3 is a fragmentary vertical sectional view thereof, taken generally on line 3—3 of FIG. 2, and particularly showing the infeed mechanism for selectively causing the dies to move toward one another.

An axial blind groove, bounded by semi-cylindrical concave surface 76, extends rearwardly into the slide base lower part from surface 75. This groove is adapted to be positioned in closely-spaced facing relation to the corresponding groove of the other slide member when the device is assembled to form a chamber in which return spring 35 is operatively mounted (FIG. 3). The practical length of this chamber is determined by the extent to which grooves 76, 76 overlap one another. Hence, the return spring acts against the ends of this chamber to urge the two slide members to move apart from one another and away from the device main axis y-y.

Another corner recess is provided between surfaces 70, 73. More particularly, this recess is bounded by an upwardly-facing horizontal planar surface 78 extending rightwardly from the upper margin of left side surface 73, and a leftwardly-facing planar vertical surface 79 continuing upwardly therefrom to join the left margin of surface 70. Surface 79 is coplanar with part surface 58.

The slide member may be formed integrally, as shown, or may be assembled from an number of subsidiary parts and components. The slide member has a number of other holes and passages that are not deemed to be material to a fundamental understanding of the improved device. Hence, a discussion of these has been omitted in order to avoid obfuscating the fundamental structure and operation of the improved device.

Figure 12:
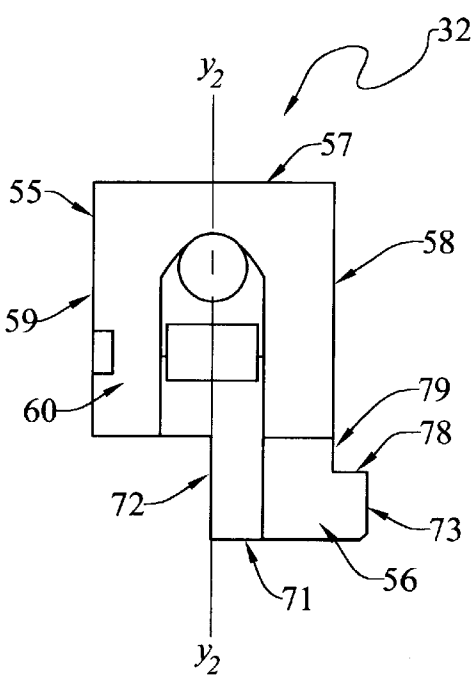
FIG. 12 is a right end elevation of the slide member shown in FIG. 8.
Figure 11:
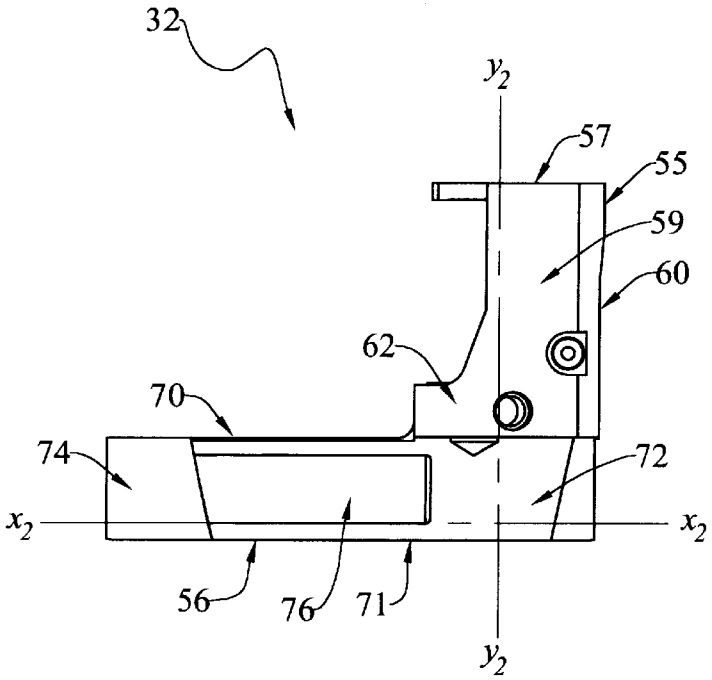
FIG. 11 is a side elevation of the slide member shown in FIG. 8.
Figure 10:
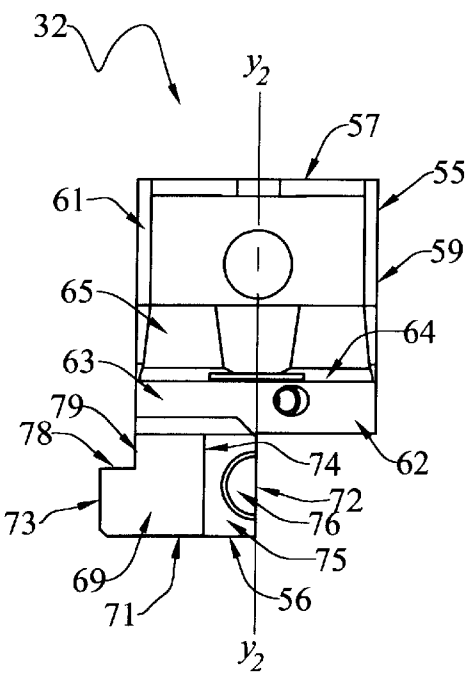
FIG. 10 is a left end elevation of the slide member shown in FIG. 8.
Figure 15:
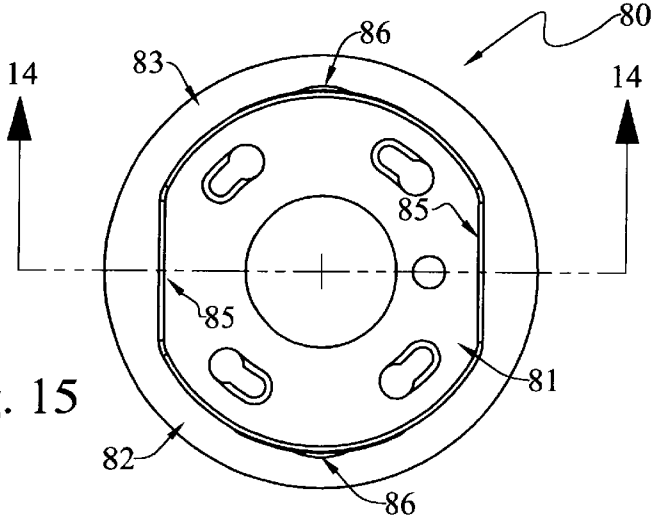
FIG. 15 is a top plan view of the shell shown in FIG. 12.
Figure 14:
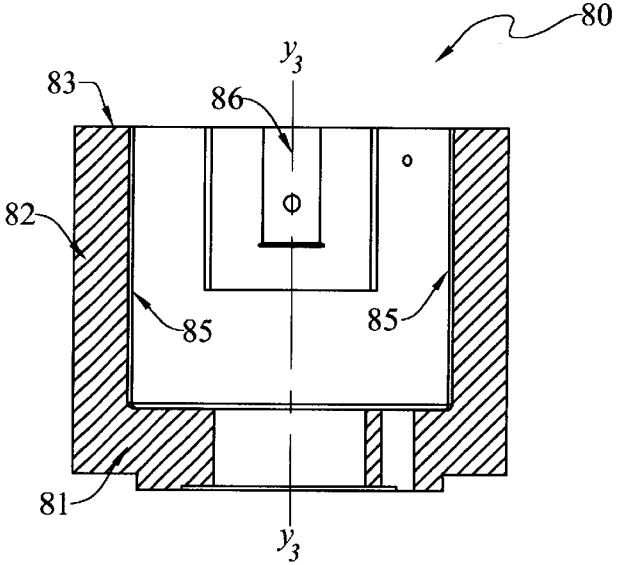
FIG. 14 is a fragmentary longitudinal sectional thereof, taken generally on line 14—14 of FIG. 12.
Figure 13:
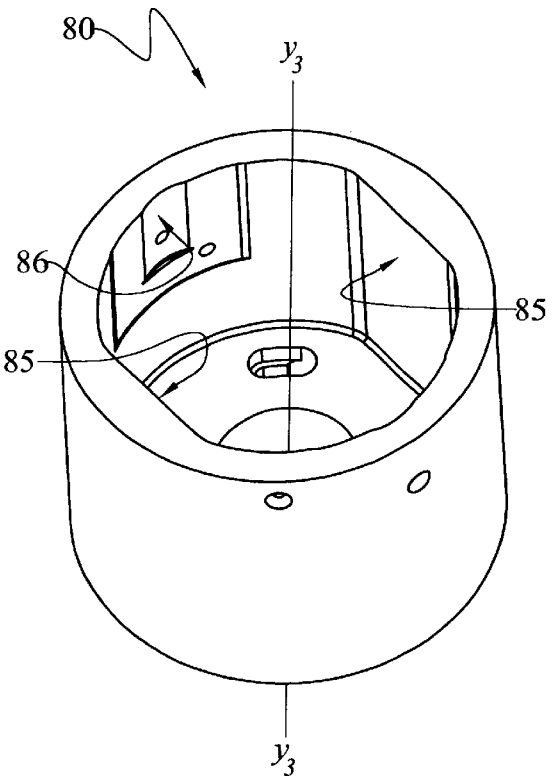
FIG. 13 is an isometric view of the infeed mechanism shell, this view is showing the diametrically-opposite flats thereon.

Shell 80 (FIGS. 12–14)

Referring now to FIGS. 3–4 and 12–13, the improved device is shown as further including a shell, generally indicated at 80, that is mounted for controlled axial movement relative to the slide base to control movement of the slide members and associated dies in a radial direction toward and away from assembled device axis y-y.

Shell 80 is shown as being a specially-configured cup-shaped member having an annular horizontal bottom 81, and a side wall structure 82 extending upwardly therefrom and terminating in an uppermost annular end face 83. The shell has an axis $y_3$-$y_3$, which is coincident with device axis y-y when the device is assembled.

More particularly, side wall 82 has an inner vertical cylindrical surface provided with one pair of diametrically-opposite large-area flats, severally indicated at 85, and another pair of diametrically-opposite small-area shallow recesses, severally indicated at 86. Adjacent flats and recesses are separated by an interval angle of 90°. The shell is provided with a plurality of mounting holes that are not deemed to be particularly material to a fundamental understanding of the device. Hence, these will not be described.

Assembled Device (FIGS. 1–4)

Device 30 is assembled as generally shown in FIGS. 1–4. The assembled device is then operatively mounted on a screw machine, a rotary transfer machine, or some other type of machine. In a screw machine, the workpiece is rotated about axis y-y relative to the stationary device. In a rotary transfer machine, the device is rotated about axis y-y relative to a stationary workpiece. Such screw machines and rotary transfer machines are well known, and a detailed discussion as to them will be omitted. Suffice it to say here that slide base 31 is held to the machine by means of a rod 88. The shell is mounted for selective and controlled, rotational and axial movement relative to the slide base.

Two wedges, severally indicated at 90, are mounted on shell recesses 89. Each wedge has an inwardly- and upwardly-inclined surface 91. A roller 92 is journaled on each slide member, and is arranged to engage the inclined surface of the associated wedge. Hence, as seen in FIG. 3, if the shell is moved upwardly relative to the slide base, the inclined surfaces of the two wedges will force the slide members to move radially inwardly toward device axis y-y. Conversely, if the shell is moved downwardly relative to the slide base, the inclined surfaces of the wedges will permit return spring 35 to expand, thereby urging the slide members to move radially outwardly away from device axis y-y.

Timing Mechanism 93 (FIGS. 1–4)

Referring now to FIGS. 1–4, the presently-preferred form of the improved attachment, which is particularly adopted for use in rolling threads on a workpiece, is shown as further including a timing mechanism, generally indicated at 93. This timing mechanism is shows as broadly including a sprocket 94 mounted fast to each die 33, and an endless chain, generally indicated at 95, engaging these two sprockets. Moreover, a pair of arms, severally indicated at 96, are operatively mounted on the slide base and are biased to more outwardly so as to maintain the chain in tension. Each lever arm is shown as having one marginal end portion 98 pivotally mounted on the slide base, and as having another marginal end portion 99. A freely-rotatable idler sprocket 100 is journaled on the end of each arm 96 and engages the chain. These arms are suitably biased, as by a spring contained within a cavity extending upwardly into the arm from its lower surface (not shown) to move radially outwardly so as to maintain the chain in tension independently of the position of the two dies relative to one another. Moreover, this operative arrangement allows the two dies to move radially relative to one another so that one die may track or follow the path or furrow left by the other. The freedom to this is accommodated by some permissible inward bowing or flexing of the arms to accommodate this purpose. However, it should be clearly understood that the timing mechanism is not limited to use with a chain and sprockets. Rather, an alternative belt and pulley arrangement or some arrangement could be readily substituted therefor.

Modifications

The present invention contemplates that many changes and modifications may be made. For example, while the preferred embodiment is shown as having two thread-rolling dies operatively arranged on slide members, other tools could be substituted for such dies. As indicated above, these tools could involve operations such as threading, knurling, burnishing, or performing other types of forming or cutting operations, and so on. Hence, the term "tool" as used in the appended claims is intended broadly and generically.

Second, while the thread-rolling dies are shown as being not rotatably powered, it should be clearly understood that such tools could be rotated by a suitable means, such as a motor, if desired.

While the preferred embodiment is shown as having two slide members that are movable toward and away from one another in a radial direction, this is merely illustrative. In practice, the attachment should have a plurality of slide members. Hence, two, three or four slide members might alternatively be provided, each within its own radial track.

Similarly, the infeed mechanism may readily be changed or modified. In the preferred embodiment, the infeed mechanism is shown as being a simple shell and wedge-type arrangement in which the axial position of the shell relative to the axial position of the slide base determines the position of the slides, and hence the roll dies, relative to the workpiece. However, it should be clearly understood that other types of mechanisms and devices for causing the slide members to move toward one another may readily be substituted therefor. Similarly, other types of return mechanism might be substituted for return spring 35. As previously noted, the timing mechanism is optional, and is not required in every instance. However, where it is desired, it may take the form of the chain-and-sprocket arrangement shown in FIGS. 1–4, or, alternatively, might take the form of a belt and pulleys, or some other form as well. Suffice it to say here that it is presently desired to permit one die to move radially relative to the others so that one die may follow the furrow of the other.

The materials of construction are not deemed to be particularly critical. Generally, the dies and the various other workpieces are formed of tool steel. Similarly, the particular structure and assemblage of elements may be changed or modified. Hence, it may be possible to make as one integral part things that have been shown sectionally in the illustrated form, and vice versa.

Therefore, while a presently-preferred form of the improved device has been shown and described, and several modifications thereof discussed, persons skilled in this art will readily appreciate that various additional changes and modifications may be made without departing from the spirit of the invention, as defined and differentiated by the following claims.

What is claimed is:

1. A device for imparting an action to a workpiece, comprising:

a slide base having an axis;

at least two members mounted on said slide base for sliding movement in a radial direction toward and away from said slide base axis;

a tool on each member;

an infeed mechanism for selectively causing said members to move toward said slide base axis such that said tools will engage said workpiece; and a return mechanism for causing said members to move away from said slide base axis; and a timing mechanism for synchronizing the operation of said tools, said timing mechanism including a sprocket mounted fast to each tool and an endless chain engaging said sprockets, said timing mechanism having at least one arm having one end pivotally mounted on said slide base, having another end biased to move toward said chain, and having an idler sprocket mounted on each arm other end and engaging said chain, each arm being operatively arranged to permit said timing mechanism sprockets to float relative to said slide base such that said tools will rotate in synchronization when said tools do not engage said workpiece, but to permit some differential angular movement between said tools when said tools do engage said workpiece.

2. A device as set forth in claim 1 wherein said workpiece is rotated relative to said slide base.

3. A device as set forth in claim 2 wherein said device is mounted on a screw machine.

4. A device as set forth in claim 1 wherein said device is rotated relative to said workpiece.

5. A device as set forth in claim 4 wherein said device is mounted on a rotary transfer machine.

6. A device as set forth in claim 1 wherein each of said tools includes a thread-forming die.

7. A device as set forth in claim 1 wherein said infeed mechanism includes a shell movable axially relative to said slide base, and a wedge operatively arranged to cause radial sliding movement of said members as a function of axial movement of said shell relative to said slide base.

8. A device as set forth in claim 7 and further comprising rollers mounted on said members and adapted to engage said wedge in rolling contact.

9. A device as set forth in claim 1 wherein said return mechanism includes a spring acting between said members.

* * * * *